United States Patent [19]

LaTorre

[11] Patent Number: 4,836,062

[45] Date of Patent: Jun. 6, 1989

[54] UNIVERSAL TOOL ADAPTES FOR BLIND FASTENER INSTALLATION TOOLS AND A UNIVERSAL METHOD FOR INSTALLATION OF BLIND FASTENERS

[75] Inventor: Joseph S. LaTorre, Santa Ana, Calif.

[73] Assignee: Lok-Fast, Inc., Newport Beach, Calif.

[21] Appl. No.: 24,418

[22] Filed: Mar. 11, 1987

[51] Int. Cl.[4] ..... B25B 13/50

[52] U.S. Cl. ..... 81/55; 81/13

[58] Field of Search ..... 81/55, 13

[56] References Cited

U.S. PATENT DOCUMENTS

| | | | |
|---|---|---|---|
| 2,789,597 | 4/1957 | LaTorre | 81/55 |
| 3,128,655 | 4/1964 | Keasler | 81/55 |
| 3,643,544 | 2/1972 | Massa | 85/72 |
| 4,457,652 | 7/1984 | Pratt | 411/38 |
| 4,630,510 | 12/1986 | Belanger | 81/55 |

OTHER PUBLICATIONS

Lok-Fast, Inc. Tooling catalog ©1984, pp. 2-13, 2A-19A, 2B-14B, 4C-16C (pages dated).

The National Screw & Mfg. Co.-"Jo-Bolt" catalog ©1961 (entire catalog).

Monogram Aerospace Fasteners-Visu-Lok II catalog, undated (entire catalog).

Monogram Aerospace Fasteners-Composi-Lok II catalog, undated, entire catalog.

Monogram Aerospace Fasteners-Composi-Lok catalog, undated entire catalog.

*Primary Examiner*—Frederick R. Schmidt

*Assistant Examiner*—Lawrence Cruz

*Attorney, Agent, or Firm*—Albert L. Gabriel

[57] ABSTRACT

A blind fastener installation apparatus for making a plurality of different tools capable of installing a plurality of types and sizes of blind fasteners which have a stationary head element and a coaxial rotatable bolt element with a protruding wrench end. A plurality of tubular nose connecting elements at one end for connection to the body of an installation tool have nose tip connecting means for releasable connection with nose tip adapting elements that are connectable with nose connecting means adapted to hold a variety of blind fastener head elements stationary during installation in which wrench connecting elements located within the nose connecting elements are connected to wrench tip elements for driving a variety of blind fastener bolt element wrenching ends.

14 Claims, 5 Drawing Sheets

FIG. 9a.
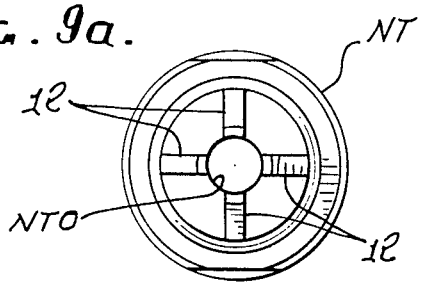
FIG. 9b.
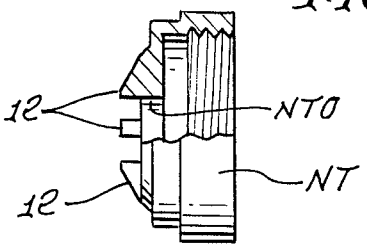
FIG. 10a.
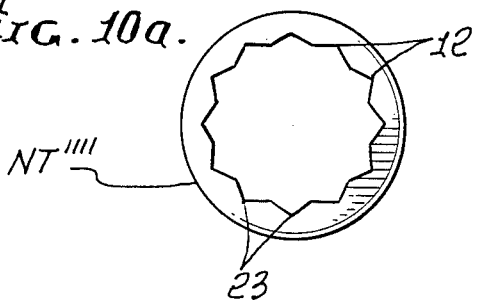
FIG. 10b.
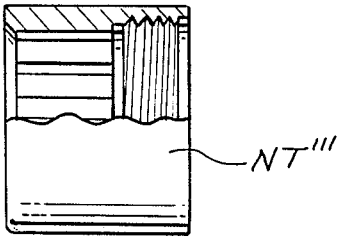
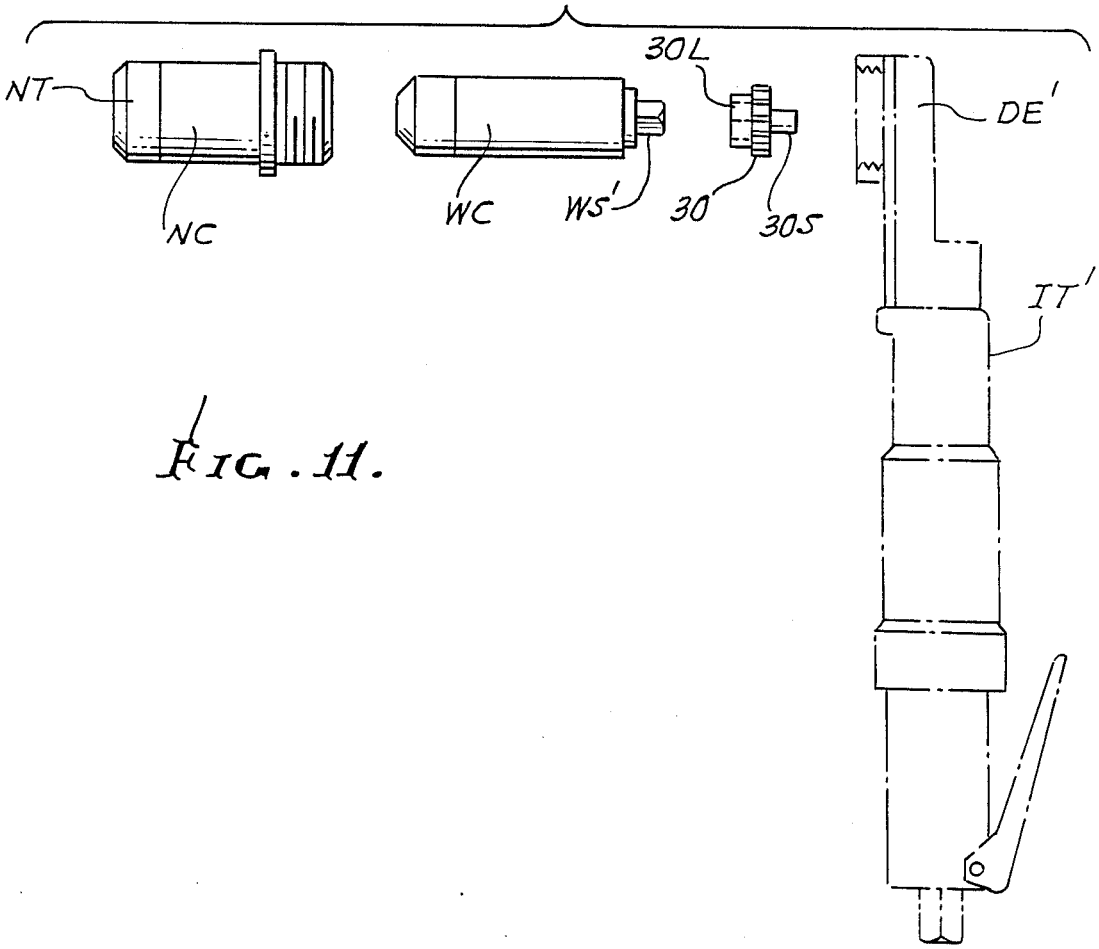
FIG. 11.

UNIVERSAL TOOL ADAPTES FOR BLIND FASTENER INSTALLATION TOOLS AND A UNIVERSAL METHOD FOR INSTALLATION OF BLIND FASTENERS

FIELD OF INVENTION

This invention relates to adapter elements for blind fastener installation tools and more particularly to universal adapter elements for ready interchangeability with various types of blind fasteners and various types of blind fastener installation tools.

BACKGROUND OF INVENTION.

At the present time, there are commercially available various configurations of blind fasteners for securing or clamping a plurality of members together to a preselected controlled tightness by assuring that the fastener is driven to the desired tightness by causing the rotatable element to fracture when a predetermined stress or load is achieved during the installation of the blind fastener. The type of blind fasteners under consideration generally are all provided with a weakened portion, formed by a V-shaped groove or the like, to respond to the rotatating forces applied to the rotatable element of the fastener during installation so as to cause the fastener to contract until it fractures at the V-shaped groove at the preselected tighteness, at which time the elements of the fastener are in clamping engagement with the members to be secured and at predetermined stress or load controlled by the fracture of the fastener. Various configurations of installation tools are commercially available for installing these types of blind fasteners. The installation tools have different types of power sources that may range from pneumatic to manual sources while some are configured in accordance with the limited space available for access to the fastener for installation purposes. At the present time each type of installation tool comprises a preselected type of a driver with unique adapter elements configured to accommodate the type of blind fastener to be installed and the configuration of the drive element of the installation tool. The adapter elements presently consist of a single nose adapter and a single wrench adapter. The nose adapter is configured to hold the head element or drive nut of the blind fastener stationary during installation of the blind fastener. The wrench adapter is configured to rotate the screw or core bolt of the blind fastener to be coupled to the rotary drive element of the installation tool for rotating the core bolt during installation of the blind fastener.

The adapter elements are used together and are mounted to an installation tool for engaging the nose adapter element with one element of the blind fastener for maintaining it stationary and to rotate another element of the blind fastener relative thereto by the wrench adaptor to provide the desired clamping of the members of the blind fastener and thereby the members to be clamped or secured together. The problem of present day adapters is that for a given size range of fastener, an adapter assembly will be useful with only one type of installation tool—it is "dedicated", i.e., an adapter assembly useful with a pneumatic type of installation tool cannot be used on a hand powered tool and vice versa, thereby requiring a large number of wrench adapters. Similarly, the nose adapters are unique to a blind fastener.

The type of blind fasteners under consideration for the purposes of the present invention have been developed over a period of some 34 years and are particularly useful in aerospace applications and are well known in the art. The blind fasteners are commercially available from various fastener manufacturers and are identified under the trademarks "Jo-Bolt", "Visu-Lok", "Visu-Lok II", "Composi-Lok", "Composi-Lok II" and "Comp-Tite". The "JoBolt", "Visu-Lok" and "Composi-Lok" family of blind fasteners are available from Monogram Industries and Voi-Sham Industries of Los Angeles, California, while the "Comp-Tite" type of fastener is available from SPS Technologies of Jenkintown, Pa. The "Visu-Lok" type of blind fastener is disclosed in U.S. Pat. No. 3,643,544. A "Composi-Lok" type of blind fastener is disclosed in U.S. Pat. No. 4,457,652. These blind fasteners have been developed for securing metallic members together and/or materials that are relatively soft, such as certain composite materials. These types of blind fasteners generally comprise a drive nut or fastener head to be maintained stationary during installation of the drive fastener and a screw or core bolt adapted to be rotated during installation. The screw or core bolt is provided with a weakened section that is responsive to the rotational torque applied thereto during installation so as to fracture at a preselected stress or load when the fastener elements are being installed. The installation procedure causes the contraction of the fastener clamping elements to cause the nut or head element to be placed into clamping engagement with one of the members to be secured and to place the clamping member carried by the rotatable or screw element into clamping engagement with the other member to be secured. The nut or fastener head and the screw or bolt are accessible from the same side of the blind fastener (the non blind side) or one side of the members to be secured so as to permit operation thereon by an installation tool. When the desired tightness of the fastener elements is achieved and thereby the desired tightness for the members to be clamped together or secured, the core bolt is designed to fracture to assure that the desired tightness has been achieved at the fastener and thereby the members clamped under the desired stress.

When considering the tooling and more specifically the adapter elements used with the installation tools for such blind fasteners, for any given size of fastener, the style of the nut or head element must be considered in order that the nose adapters may be properly coupled to the head for maintaining it in a relatively stationary position during the installation thereof. These heads have various styles and therefore require an individual nose adapter that is configured to be coupled to the head configuration for the particular type of blind fastener to be installed. In the use of the aforementioned types of blind fasteners, the various head styles that are presently in use include a flush head for the Jo-Bolt, Visu-Lok and Composi-Lok types of fastener. A protruding hexagonal head style is used on the Jo-Bolt fastener, and a millable head is found on a Jo-Bolt fastener wherein the protruding portion of the head can be milled off after the fastener is locked in place. A reduced flush type of head is used on the Jo-Bolt, Visu-Lok and Composi-Lok types of fastener. The blind fasteners that have been developed for fastening the composites such as the Visu-Lok II and Composi-Lok II utilize an additional component for installation, namely, a drive nut having a desired configuration such as a 12 point drive nut. Accordingly, one end of the conventional nose adapters must be configured to be coupled to the head style of the blind fastener selected for use in any particular fastening application. The other end of the nose adapter is constructed and defined to be secured to the installation tool conventionally by being threaded thereto for maintaining the head in a stationary position during installation of the fastener.

Various types of installation tools are presently available for use with the aforementioned types of blind fastener. The installation tools may be pneumatically powered or hand powered or have various configurations to accommodate the available space at the location of the members to be secured together for locating the tool and operating on the blind fastener. Typical blind fastener tools are known in the art and two such tools are disclosed in U.S. Pat. Nos. 2,789,597 and 3,128,655. These patents disclose the method of use of the prior art type of installation tools for blind fasteners of their time. Various other types of installation tools are commercially available, including those from Lok-Fast, Inc. of 864 West 16th Street, Newport Beach, Calif. 92663. Lok-Fast, Inc. supplies the types of installation tools required for the type of blind fasteners under consideration for the purposes of this invention and the installation tools are the typical tools that are identified by Lok-Fast, Inc., as pistol grip, torque responsive pneumatic tools, pneumatic right angle tools, close quarter tools and hand ratchet type tools. The pistol grip tools, for example, are useful with blind fasteners sold under the trademarks "Visu-Lok", "Composi-Lok", and "Comp-Tite", and similar right-angle pneumatic drivers are available for use with the same series of blind fasteners. Also, right angle, pneumatic standard drivers are characterized for use with this family of blind fasteners. In addition, a right angle, pneumatic close quarter driver, a ratchet hand tool driver and a close quarter ratchet hand tool driver is available from Lok-Fast, Inc. for use with the Visu-Lok, Composi-Lok and Comp-Tite family of fasteners. As indicated hereinabove, the installation tools of the prior art must be utilized with the desired adapter elements that are dedicated for use with the type of installation tool. Accordingly, the wrench adapter of the adapter system for such prior art tools is configured to be rotatably coupled to the output rotatable element of a unique type of installation tool. Since each of these installation tools has a different type of rotatable element, the wrench adapter must be configured to be readily rotatably coupled to such a driving element for the installation tool and its opposite end coupled to the screw or core bolt element of the blind fastener. The prior art adapter assemblies are presently constructed and defined so that the wrench adapter is sized to be mounted inside the nose adapter when it is coupled to the rotatable element of the installation tool with the nose adapters secured in a stationary relationship with the installation tool for installation operations.

Accordingly, it should be evident that the present state of the art is that for each given size blind fastener each of the various styles of blind fasteners available and the various types of installation tools available , must be considered in order that the correct adapter assemblies for the installation tools and the blind fasteners may be properly assembled for installing the selected blind fastener. This results in the requirement for the relatively large number of nose adapters and wrench adapters in the present methods of installing the blind fasteners under consideration. It has been determined that to install the JoBolt, Visu-Lok, and Composi-Lok family of fasteners that are manufactured by Monogram and Voi-Shan Industries, for example, it is necessary to presently provide approximately 318 nose adapters and approximately 61 wrench adapters. Accordingly, in order to install one of these types of blind fasteners, a nose adapter that is useable with a particular head style and a wrench adapter that is useful with a particular type of installation tool must be resorted to, and numerous nose adapters and wrench adapters that are not useful must be culled through and set aside, Tool component selection for driving any particular type and size of blind fastener is therefore made difficult and time-consuming. This results in the requirement for the relatively large number of nose adapters and wrench adapters in the present methods of installing the blind fasteners under consideration.

Some blind fasteners of the type under consideration have also been modified to add an additional component thereto, namely, a drive nut. These drive nut fasteners have been identified in the trade by the trademarks "Visu-Lok II" and "Composi-Lok II". The use of these types of "drive nut" fasteners has resulted in the simplification of the installation tools in that only two nose adapters are required for the installation of these types having 5/32" to ⅜" diameters. A separate wrench adapter is still required for each diameter fastener in both of the Visu-Lok II and Compsi-Lok II drive nut type blind fasteners. However, the drive nut type blind fasteners are only used for fastening composite structures and not metal structures, so that the partial simplification of tooling enabled by the drive nut fasteners is only applicable in a very limited, specialized situation.

SUMMARY OF INVENTION

The present invention for the first time in the history of the Jo-Bolt family of blind fasteners, provides improved and simplified adapter elements for installation tools for selected types of blind fasteners of the types discussed hereinabove wherein the nose adapters and wrench adapters are each constructed of multiple elements that can be readily engaged and disengaged from one another to permit the improved adapter elements to be universally utilized with preselected types of blind fasteners and/or preselected types of installation tools without the need to replace an entire adapter system when a change in the type or size of blind fastener to be installed is required, or when a change in the type of installation tool is required. The universal system of the present invention eliminates the need for a large number f adapter elements that have heretofore been essentially useable for only a single or "dedicated" purpose. The universal nose wrench adapting elements of the present invention provide significant user advantages in that for any given size and type fastener, any nose tip adapter element may be interchanged onto or from any pneumatic or ratchet driven installation tool, and even to and from torque testing devices and certain fastener removal tools (nose tips only) for use with another type of blind fastener i.e., the Visu-Lok I or II blind fastener to the Composi-Lok I or II blind fastener, or the reverse.

The nose adapting elements of the present invention are constructed of multiple pieces consisting of at least a universal nose tip element and a nose tip connector element. The nose tip element is configured to engage the head of the fastener or the drive nut in accordance with the configuration of the head or drive nut element of the blind fastener for holding it stationary. The nose tip connector element is readily coupled to the nose tip element to form the complete nose adapter and which assembly is attached to the installation tool by means of the nose connector element.

The wrench adapter element is constructed of multiple pieces and generally is a three-piece element including a wrench tip element, a wrench connector element and a drive shank element. The drive shank element is configured to the particular type of drive element for the selected installation tool and is secured to the wrench connector and the connector tip elements being similarly connected. The wrench tip element is configured to receive the screw or core bolt of blind fastener to rotate it when it is coupled to the installation tool. In certain applications, such as close quarter configurations, the wrench adapter may be a two-piece design.

As a result of the provision of such universal nose adapting element and wrench adapter elements, the number of adapters required for the selected line of blind fasteners reduces down so that there are only approximately 39 nose tip adapters required and approximately 9 wrench tip adapters for the same aforementioned family of Monogram/Voi-Shan blind fasteners. This, then, results in significant advantages to the user in that all adapting elements are interchangeable with respect to all types of installation tools for the preselected types of blind fasteners. In addition, a user realizes a reduction of inventory of adapter elements and the installation tooling costs, due to the interchangeability of the elements is also reduced and any emergency tool shortage can be solved due to the universal system.

The simple means in which the adapter elements may be connected together and disconnected, allows the installer to create custom assemblies by the use of varying length connectors to meet special access problems which are extremely critical in 90 degree right angle applications where access to the fastener is limited.

Accordingly, for the first time in the 34 year history of the Jo-Bolt family of blind fasteners, the installation tooling and the removal tooling can be purchased in basically kit form so that they may be inventorized for versatility and used as the application arises, while purchasing only those pieces of the adapting elements which call for replacement or repair, normally the nose tips. The total compatibility with the existing installation tool systems further adds to the advantages of the simplification when the present invention is resorted to.

From a structural standpoint, the universal tooling adapters of the present invention are useful for preselected types of blind fastener installation tools for installing preselected types of blind fasteners wherein each type of blind fastener comprises an element to be held stationary and an element to be rotated during installation. The blind fasteners have wrenching surfaces accessible from the same side when the fastener is coaxially mounted through aligned apertures of a plurality of members to be secured together by the fastener. The relative rotation of the stationary and rotatable elements of the blind fastener cause the contraction of the fastener to place the stationary element into clamping engagement with the adjacent member to be secured and to place the clamping member carried by the rotatable element into clamping engagement with the adjacent member of the plurality of members to be secured together and arranged on the opposite side thereof from the stationary element. The rotatable element is constructed to permit it to advance through the stationary element to provide a preselected tightness controlled by the fracture of the rotatable element when the preselected tightness between the fastening elements and the secured members is achieved. The relative rotation of the aforementioned fastener elements is provided by a preselected type of installation tool having a rotatable driving means having an individual driving end configuration unique to the selected type of tool.

The universal tooling adapters of the resent invention comprise nose tip means constructed with a configuration conforming with the configuration of a stationary element of the blind fastener to be installed for holding the element stationary during installation. The nose adapting elements include a nose connecting means which is secured to the nose tip means at one end and secured to the blind fastener installation tool at the other end for holding the assembled nose means in a stationary position. The wrenching means for use with the nose adapter includes wrench adapting means constructed and defined at one end to be readily rotatably and releasably coupled to the driving end configuration for the installation tool and thereby rotatably driven by the tool. Wrench tip means is also provided which is defined for rotatably engaging the rotatable element of the blind fastener at one end and to be releasably secured to the wrench adapting means to be rotated whereby the rotatable element of the fastener is rotated. Each of the elements of the nose adapting means and the wrench adapting means may be readily detached from one another to be replaced in accordance with the selected type of fastener to be installed and/or installation tool to be used.

BRIEF DESCRIPTION OF THE DRAWINGS

These and other features of the present invention may be more fully appreciated when considered in the light of the following specification and drawings, in which:

FIG. 9*a* is a front elevational view of the nose tip adapter element of the universal adapting system for use with a blind fastener having a flush head;

FIG 9*b* is a partial sectional and elevational view of the element of FIG. 9*a;*

FIG. 10*a* is a front elevational view of a nose tip adapter element of the universal system for use with a blind fastener having a drive nut configuration with 12 drive points; and FIG. 10*b* is a partial elevational view and a partial sectional view of the element of FIG. 10*a;*

FIG. 11 is an exploded view of the secured nose adapting elements and secured wrench elements of the universal system as they may be coupled to the right angle, pneumatic installation tool with the tool illustrated in dotted outlined and its output drive member shown illustrated spaced therefrom;

Figure 1:
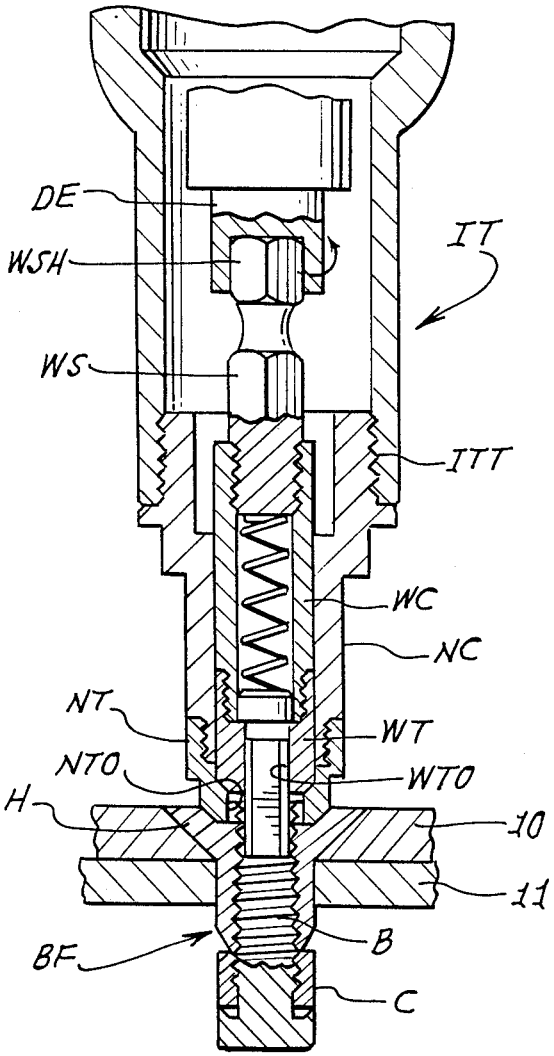
FIG. 1 is a partial cross sectional view of a pneumatic pistol installation tool having the universal adapting elements embodying the present invention coupled thereto in driving relationship with a blind fastener upon commencing the blind fastener installation procedure.

Now referring to the drawings, the universal nose/-wrench adapting elements of the present invention for use with preselected types of installation tools and preselected types of blind fasteners will be described in detail. In order to best appreciate the advantages and features of the present invention, the preselected types of blind fasteners with which the present invention is particularly useful will first be described. The preselected types of blind fasteners that are to be installed with the universal nose/wrench elements of the present invention are based on what is known in the art as the "Jolt-Bolt" family of fasteners commonly available from Monogram and Voi-Shan Industries of Los Angeles, California, as discussed hereinabove. The basic Jo-Bolt type of fastener has been continuously improved upon over the last 34 years and sold under various trademarks, such as "Visu-Lok", "Visu-Lok II", "Composi-Lok" and "Composi-Lok II", by both Monogram and Voi-Shan. Similar blind fasteners are manufactured and sold by SPS Technologies under the trademark "Comp-Tite". The basic configuration of a Visu-Lok type of blind fastener is disclosed in U.S. Pat. No. 3,643,544, and is the type of blind fastener illustrated in FIG. 1 of the present invention shown mounted in a pair of members to be secured. The members 10 and 11 have been provided with aligned apertures for accepting the blind fastener BF therein. The later generations of blind fasteners are basically the same as the Visu-Lok but include improvements to the fastener heads, such as the use of a "drive nut" and features for use of the blind fastener with composite materials, as well as the metallic materials to be secured Monogram Industries, for example, identifies these generations of blind fasteners for use with composite materials, as the "Composi-Lok" and "Composi-Lok II" blind fasteners. The basic Composi-Lok blind fastener is disclosed in U.S. Pat. No. 4,457,652.

The blind fastener BF illustrated in FIG. 1 for the purposes of the present invention is a Visu-Lok type blind fastener of the type manufactured and sold by said Monogram Industries and Voi-Shan Industries. The blind fastener BF is shown with a flush steel type head and is basically operative as disclosed in the Visu-Lok U.S. Pat. No. 3,643,544. The details of construction of the blind fastener and the installation thereof may be better appreciated by reference to the U.S. Pat. No. 3,643,544 patent disclosure which disclosure is incorporated herein by reference. The blind fastener BF is shown installed in a head flush relationship in aligned apertures for the pair of members 10 and 11 to be secured or clamped together by the installed blind fastener BF.

Figure 2:
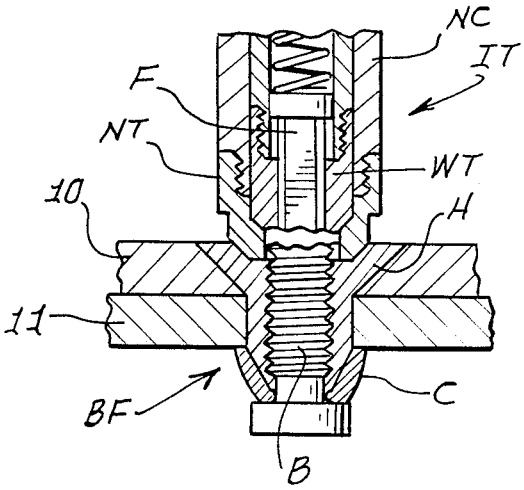
FIG. 2 is a partial sectional view similar to FIG. 1 illustrating the essentially completed installation procedure for the blind fastener providing the clamped work pieces.
Figure 5:
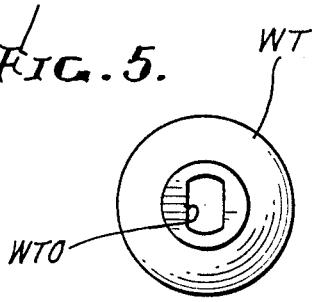
FIG. 5 is a front elevational view taken along the line 5—5 of FIG. 4 illustrating the fastener engaging element of the wrench tip adapter element.
Figure 3:
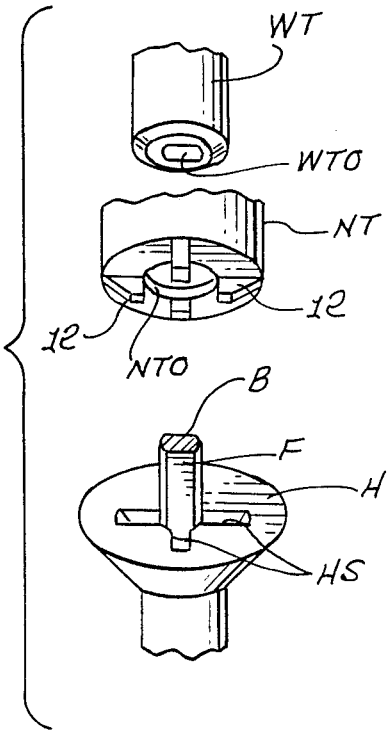
FIG. 3 is an exploded view, with portions broken away, of the head end of a blind fastener and illustrating a wrench tip element and a nose tip element in their relationship to be coupled to the blind fastener for installation purposes.

The blind fastener BF comprises certain basic elements that must be identified and understood for the complete understanding of the installation of such types of blind fasteners in accordance with the present invention. The blind fastener BF illustrated includes a screw or bolt element B having a nut or head H rotatably arranged therewith. The element B carries a clamping sleeve C on the blind end thereof. The blind fastener BF is illustrated so that the head H or the stationary element of the blind fastener is mounted on what is considered the non-blind side of the installation or on the side above the top side of the member 10 to be secured, as illustrated in FIG. 1, while the blind side would be considered the side below the member 11 to be secured. The non-blind side of the disclosed arrangement in FIG. 1 is the side to which the installation tool IT is applied to the fastener BF. Accordingly, the head H can also be considered as the non-blind member of the fastener BF. The bolt or screw B and the sleeve C are the blind members of the fastener BF. The screw B has a threaded shank which is threadedly engaged with the head H rotatably secured thereto and has a driving connection at its free end. The driving connection conventionally may consist of wrench flats or slabs F arranged on opposite sides of the screw B (see FIG. 3) adapted to be rotatably engaged by the wrench tip element WT for an installation tool IT as illustrated in FIG. 1–3. The screw or shank B is also usually provided with a weakened portion or break groove generally formed by a V-shaped groove (not shown) arranged at a predetermined point on the shank to cause the screw to fracture at the break groove when the desired amount of clamping forces have been applied to the fastener clamping members and thereby the members 10 and 11 during the installation of the blind fastener BF.

The head H has a coupling configuration that allows it to be secured by the nose adapter elements NT of an installation tool, and for the purposes of explaining the present invention, the head H is considered as having a plurality of slots HS that may be interengaged by a nose tip adapting element NT for holding the head H in a stationary position. The wrench adapting element WT, then, when placed in engaging relationship with the screw B, cause the screw B to rotate relative to the head H to draw and expand the nut end of the sleeve C over the frustoconical or inner end of the head H to form an internal or blind head; see FIG. 2. The screw B is continuously rotated by the installation tool IT to contract the length of the fastener and expand the sleeve C over the frustoconical surface of the head or nut portion H thereof and move it into clamping engagement with the member 11 to be fastened while the head H is placed into clamping engagement with the member 10. This rotation of the screw B is continued until the driving connection breaks away from the screw B at the aforementioned weakened section and therefore insuring that the tightening of the fastener has been accomplished to a predetermined stress or load and thereby the desired clamping forces for the members 10 and 11 has been accomplished. This is the basic construction and operation of the blind fastener types under consideration for the purposes of the present invention. FIG. 2 illustrates the installed blind fastener BF at the time the installation procedure has been completed.

Now for the purposes of the present invention, it will be seen that the head H of the blind fastener BF is the stationary element and in the later generations of blind fasteners is utilized in the same fashion as the "drive nut" provided for the Visu-Lok II and Composi-Lok II types of blind fasteners. The drive nut or head element, then, of the type of blind fasteners under consideration can be considered to be the element of the blind fastener that is held in a stationary relationship with respect to the screw or rotary member B that is operated on during the installation procedure. The screw or core bolt element B is the element to be rotated during installation of the blind fastener and is the common rotary element in the preselected types of blind fasteners under consideration.

The stationary elements of the blind fastener installation tool IT at configurations for engaging the ends of the various exposed head elements H by means of a nose adapting element for holding it in a stationary position during the installation procedure. The various types of stationary elements and their configurations are illustrated in FIG. 6A–6B through 10A–10B and will be considered more fully hereinafter. Similarly, wrench adapting elements of the installation tool IT are configured to be engagable with the various head configurations of the rotary elements B of the blind fastener BF.

For any given range of fastener head styles and a given fastener diameter, each fastener in size range will have an identical core bolt diameter and therefore the same size installation tool for installing the fastener. The same wrench tip adapter can therefore be used for the size range. The wrench shank adapting elements, however, must have individual shank adapter elements since the various types of installation tools have differently configured output drive elements to which they must be coupled. Accordingly, the wrench shank adapting elements must be configure to be readily coupled thereto and the common types of installation tools for this purpose are illustrated in FIGS. 11 through 16.

The universal adapter elements of the present invention are illustrated in FIG. 1 in their operative relationship with the blind fastener BF at the time just prior to the actuation of the installation tool IT. The universal adapting elements in accordance with the present invention comprise nose adapting elements that are illustrated as two elements identified as the nose tip adapter NT and the nose connector NC. The nose tip adapter NT has a configuration at its free end conforming to the configuration of the stationary element of the blind fastener BF for holding the element in a stationary position during the installation of the blind fastener BF. The holding end of the nose adapting element NT is best illustrated in FIG. 3 and is shown with the dependent coupling or holding elements 12 sized for being snugly received in the four slots HS provided on the top side of the head H; see FIG. 3. The coupling or holding elements 12 may be of any configuration so as to be securely mounted to the head slots HS without slippage during the fastener installation to prevent the head H from being rotated. The elements 12 are illustrated as integral with the nose tip NT and dependent therefrom. The elements 12 have a general triangular configuration and are spaced apart at approximately 90 degrees from one another to readily slip into the head slots HS. The nose tip element NT has a central aperture NTO for slidably accommodating the screw B therein; see FIG. 1.

The nose tip adapting element NT is coupled to a nose connecting element NC as illustrated in FIG. 1. In the preferred embodiment the nose adapting elements NT and NC are each threaded so as to be readily engageable and disengageable from one another. The nose tip adapting element NT is shown with internal threads adjacent the end thereof opposite to the end having the holding elements 12, with the nose connector adapting element NC having corresponding external threads for threaded engagement with the element NT. Similarly, the opposite end of the nose connector NC has internal threads for coupling it to an installation tool IT. In the use of the pneumatic pistol type of installation tool IT, the driving end of the tool housing is provided with internal threads ITT. When the nose adapter elements NT and NC are secured together and to the tool threads ITT, they are maintained in a stationary position during the operation of the installation tool IT.

Figure 4:
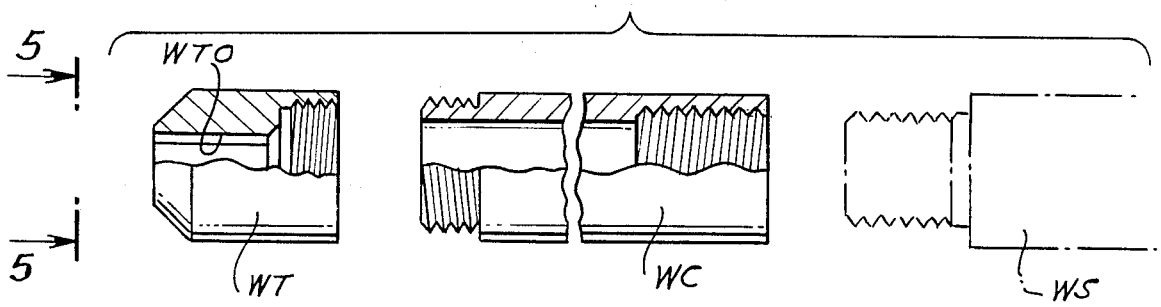
FIG. 4 is an exploded view of the multiple wrench adapter elements in accordance with the universal adapter elements of the present invention and illustrating the shank wrench element in dotted outline.

As in prior art installation tool adapters, the wrench adapting elements are sized so as to be contained within the nose adapting elements. In FIG. 1 the wrench adapting elements are illustrated as three in number. The three elements are identified as the wrench tip adapting element WT, the wrench connecting element WC, and t shank element WS. The three wrench adapting elements are shown in FIG. 1 secured to one another and mounted within the assembled nose adapting elements NC and NT and coupled to the drive end DE of the installation tool IT. The wrench tip adapting element WT has a central aperture WTO conforming to the shape of the wrenching end of the screw B for receiving the screw B of the blind fastener BF and particularly engages the flats F on the opposite sides of the screw B for imparting rotation to the screw B. The opposite end of the wrench tip adapting element WT is constructed and defined to be coupled to a wrench connecting element WC, which in turn is coupled to the wrench shank adapter WS. For this purpose the wrench tip adapting element WT is illustrated with internal threads at the end opposite to the screw engaging end for receiving the externally threaded end portion of the wrench connector WC. Similarly, at its opposite end the wrench connector WC has internal threads for receiving external threads on the wrench shank adapting element WS. The shank adapting element WS has its one end provided with external threads for coupling to the wrench connector WC and, as illustrated in FIG. 4 in dotted outline, varies in configuration in accordance with the type of drive end DE for the tool IT. In FIG. 1 the shank end of the element WS is illustrated with a hexagonal end configuration WSH so as to drivingly engage the hexagonal opening of the drive end DE for the tool IT illustrated. In this manner the operation of the tool IT will cause the drive end DE of the installation tool IT to be rotated and thereby rotate the connected wrench adapting elements WS, WC and WT and whereby the engaged screw B will be rotated.

From the above description it should now be evident that the stationary elements of the universal adapting system of the invention comprises the nose adapting elements NT and NC, namely, the nose tip adapter and the nose connector elements when the two are coupled together such as by threading the two together as illustrated in FIG. 1, for example. The two secured elements comprise, the nose adapting elements. Similarly, the rotatable wrench adapter is constructed of three separate readily engageable and disengageable elements, namely, the wrench tip element WT, wrench connector element WC, and the wrench shank adapter WS. When the three elements WT, WC and WS are coupled together, such as by threading them to one another as illustrated in FIG. 1, a complete wrench adapter is defined.

A significant part of the nose adapter, of course, is the configuration of the nose tip element NT at its outer, free end that is configured to be coupled to the stationary element H of the blind fastener BF to be installed. This nose tip, then, can be utilized with a particular type of blind fastener, such as the nose tip NT illustrated in FIG. 1 for use with a Visu-Lok flush type head element and therefore the nose tip adapting element NT is provided with the protrustions 12 for interfitting into the head slots HS. This nose tip adapting element NT is also illustrated in FIGS. 9A and 9B.

In accordance with the present invention, the definition of the nose adapter as a two-piece unit permits interchanging the nose tips among all installation tool configurations and further permits this interchange for the composite fasteners identified as the Visu-Lok II and Composi-Lok II and their installation tools. In most cases, it has been found that for a given installation tool only three complete universal nose adapters are required for all blind fastener head styles for the complete range of fastener sizes from 5/32" through ⅜" are needed.

Figure 6A:
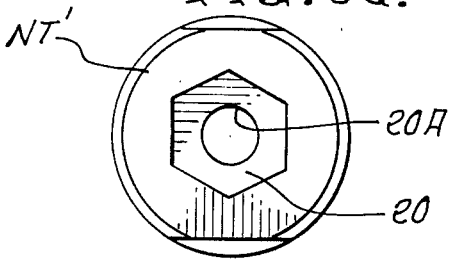
FIG. 6*a* is a front elevational view of a nose tip adapter element of the universal system for use with a blind fastener having a millable head configuration.
Figure 6B:
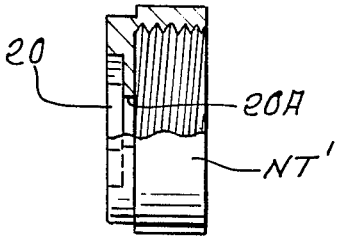
FIG. 6*b* is partial cross-sectional view and side elevational view of the element of FIG. 6*a*.
Figure 7A:
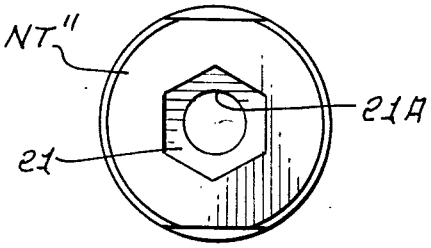
FIG. 7*a* is a front elevational view of the nose tip adapter element of the universal system for use with a blind fastener having a protruding, hexagonal style head.
Figure 7B:
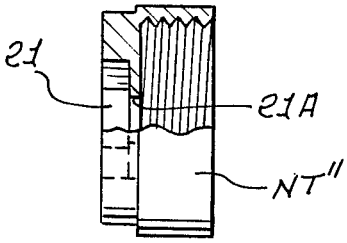
FIG. 7*b* is a partial cross-sectional view, partial elevational view of the element of FIG. 7*a*.

The nose tip connectors NT illustrated in FIGS. 6*a*–6*b* through FIG. 8*a*–8*b* and 10*a*–10*b* are each configured for a uniquely configured stationary element or head for a blind fastener of the types under consideration. With reference to FIGS. 6*a*–6*b* it should be noted that this nose tip NT′ is adapted for use with aJo-Bolt type of blind fastener which has a millable head style. For this purpose the nose tip NT′ has a hexagonal open end configuration 20 at one end thereof for engaging and holding the hexagonal shaped head of the Jo-Bolt standard millable head. The hexagonal element 20 has a central aperture 20A for receiving and accommodating the screw portion B of the conventional Jo-Bolt millable head. The opposite end of the nose tip adapter NT′ is internally threaded as illustrated in FIG. 6*b* for ready coupling to the nose connector NC described hereinabove, to complete the assembly of the nose adapting elements. Similarly, FIGS. 7*a*–7*b* illustrate the nose tip adapter NT″ which has its head receiving end configured for use with a Jo-Bolt fastener having a protruding hexagonal head style. This nose tip adapter element NT″ has a hexagonal open end 21 which is deeper than the corresponding open end of FIGS. 6*a* and 6*b* for engaging the hexagonal shaped head of the blind fastener, and also has a central opening 21A for accommodating the screw element of the blind fastener. The protruding head style type of blind fastener when installed has the hexagonal type head extending above the surface of the members to be connected as distinguished from the flush style of FIG. 1. The remaining portion of the nose tip adapter element NT″ is threaded internally for receiving the nose connecting element and C, as described hereinabove.

Figure 8A:
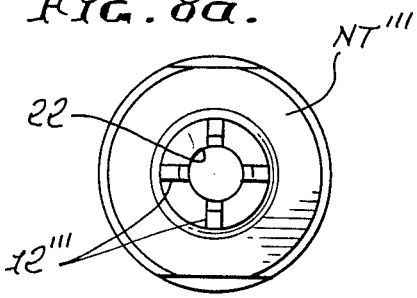
FIG. 8*a* is a front elevational view of the nose tip adapter element of the universal system for use with a blind fastener having a reduced flush head.
Figure 8B:
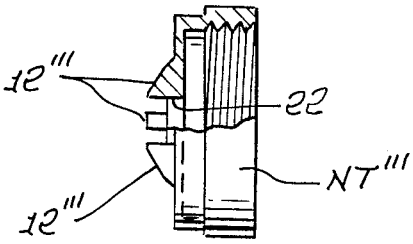
FIG. 8*b* is a partial cross-sectional, partial elevational view, of the element of FIG. 8*a*.

Similarly, the nose tip adapter NT‴ illustrated in FIGS. 8*a*–8*b* are configured for use with a blind fastener having a reduced flush head such as is found in the commercially available Composi-Lok, Visu-Lok and Jo-Bolt fasteners. This nose tip adapter NT‴ has the protruding coupling elements 12‴ for engagement with the corresponding holding slots in the stationary element of the blind fastener and the central screw aperture 22.

FIGS. 9*a* and 9*b* further illustrate the nose tip adapter NT shown in FIGS. 1–3 and described in detail in connection with those figures.

FIGS. 10*a*–10*b* illustrate the configuration of a nose tip adapter NT⁗ for use with blind fasteners that have the separate blind nut for installation purposes and the particular style illustrated in FIGS. 10*a* and 10*b* is for engaging a 12 point drive nut. The 12 points are similarly identified by the reference numeral 23 to effect the desired holding action to the complementary shaped drive nut. Such a drive nut is found in the commercially available Composi-Lok II and Visu-Lok II fasteners. In each of the above described nose tip elements, the nose connector NC is adapted to be readily engageable and disengageable by threading it to the nose tip adapting elements. It should be apparent then, that when the type of blind fastener to be installed is changed, if the same type of installation tool is employed for the installation procedure, the nose tip element NT merely needs to be disengaged from the nose connector NC and replaced by a nose tip adapter NT that has the configuration for holding the stationary element of the different style blind fastener to be installed. Similarly, if the nose tip adapter NT is worn, it can be readily replaced inexpensively by merely replacing the worn nose tip element NT with a useable element without requiring the entire nose tip and nose tip adapting elements to be replaced and disassembled.

As described hereinabove, the wrench adapter for the universal type of adapting elements in accordance with the present invention consists of three adapting elements, namely, the nose tip adapting element NT, the connector element WC and the shank adapter WS. These elements are readily coupled to one another and to the driving element of the selected installation tool for installing the blind fasteners BF of the types under consideration. In the event the same type of blind fastener is to be installed by different types of installation tools due to different accessibility to the point where the blind fastener is to be installed, or where a pneumatic power source is not readily available, it is therefore necessary to change the type of installation tool to carry out the installation procedure. This change in the type of installation tool requires a change in the shank adapter element WS coupling configuration due to the change in output drive elements for the various types of installation tools. The various types of installation tools that are presently commercially available are described in the catalogue of Lok-Fast, Inc. of 864 West 16th Street, Newport Beach, CA 92663. This catalogue bears a copyright date of 1984. This Lok-Fast catalogue describes the various types of commercially available installation tools for various applications of the blind fasteners of the type under consideration and the disclosure thereof is incorporated herein by reference. This catalogue not only describes the various types of installation tools but also the conventional types of adapter, elements for use with the family of blind fasteners that are currently in. use. Some of these types of installation too are also described in the aforementioned U.S. Pat. Nos. 2,789,597 and 3,128,655. The types of tools that are presehtly commercially available and must be considered for the purposes of the present invention, in addition to the pistol grip type pneumatic installation tool of the type illustrated in FIG. 1, will now be considered in conjunction with FIGS. 11–15.

Referring to FIG. 11, it should be noted that the installation tool IT′ illustrated in dotted outline therein is normally provided with an output drive gear mounted within the drive end DE′ for driving the wrench shank adapting element WS. In the type of right angled pneumatic tool IT′ illustrated in FIG. 11, the output drive gear 30 is provided with a stub shaft 30S coupled to the tool IT proper. The opposite side of the drive gear 30 is provided with an open ended protrusion 30L having an internal hexagonal shape for drivingly receiving the hexagonal shaped end of a wrench shank adapting element WS′. The element WS′ is illustrated as it would be secured with the wrench connector WC, and is further illustrated in exploded relationship with the universal nose adapting element comprising the nose tip element NT secured to the nose connector NC. The right hand end of the nose connector NC is externally threaded, to be received in the internally threaded opening 40 at the drive end DE for the right angled penumatic tool IT′.

Figure 12:
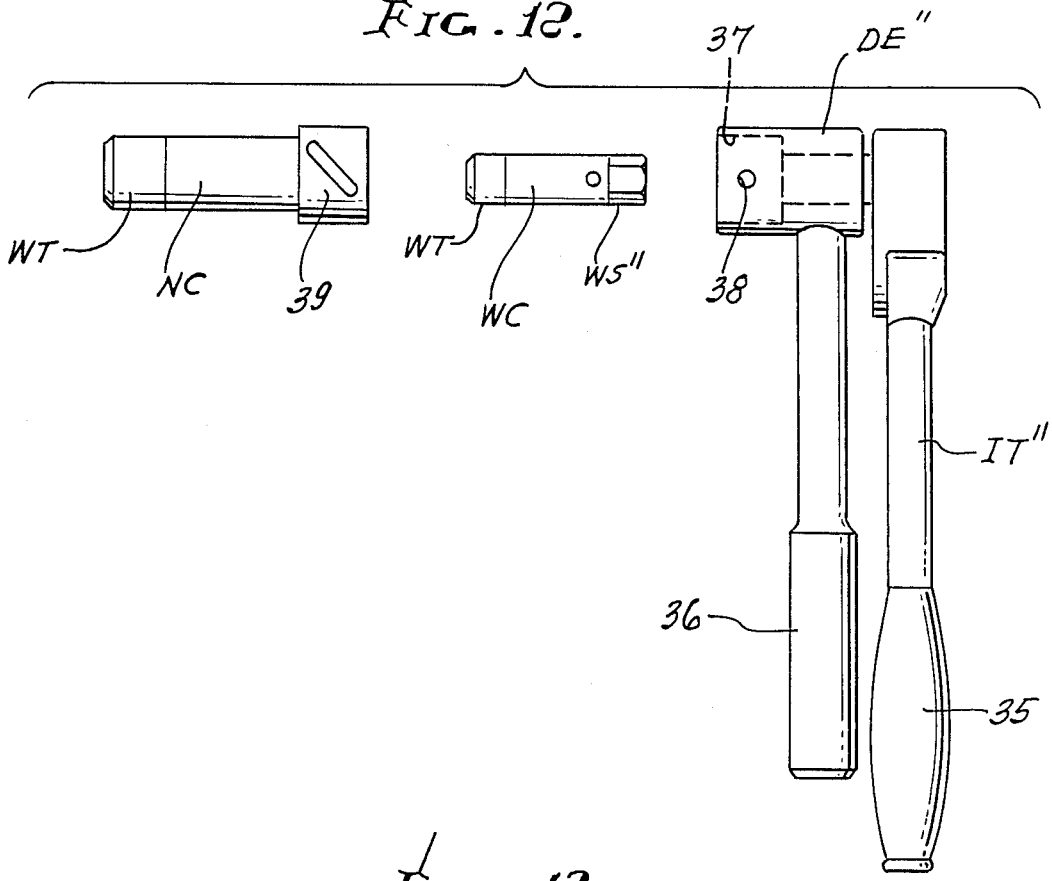
FIG. 12 is a view similar to FIG. 11 illustrating the assembled universal adapter elements as they may be utilized with a ratchet hand installation tool.

Now referring to FIG. 12, a ratchet hand installation tool IT″ will be considered concerning the necessary configuration of the shank adapting element WS″ for employing the universal adapter system of the present invention. The hand ratchet installation tool IT″ is of conventional construction and in operation the ratchet is operated by operating the handle 35 while the operator's other hand holds the handle 36 stationary. In operating the handle 35 a rotary motion is generated and is transmitted through a socket at the drive end DE″. The drive end DE″ of the hand ratchet IT″ is provided with a socket member that has a hexagonal opening in its usual configuration for receiving a complementary hexagonal end of a shank adapting element WS″ in driving engagement therewith. As illustrated in FIG. 12 the wrench adapting elements are three in number and are secured together with the wrench adapting element WS″ arranged adjacent the right hand end of the assembly for insertion into the portion of reduced diameter of the drive socket 37 of the tool IT″. On the left hand side of the drive socket 37 for the hand tool IT′ is an enlarged socket element having an opening 38 on the one side thereof for receiving a set screw. The assembled nose adapting elements NT and NC are illustrated to the left of the wrench adapting elements and the nose connector NC is secured to a coupling element 39 secured to the right hand end of the nose connector NC for insertion in the enlarged base of the socket 37 at the drive end DE″ for the tool IT″. The coupling element 38 has a slot arranged angularly of the side thereof so as to receive a set screw (not shown) inserted through the aperture 38 for securing the assembled nose adapting elements to the housing of the tool IT″. In this manner the wrench adapting elements would be rotated by the operation of the handle 35 and the nose adapting elements maintained stationary by holding the handle 36 during the installation of a blind fastener.

Figure 13:
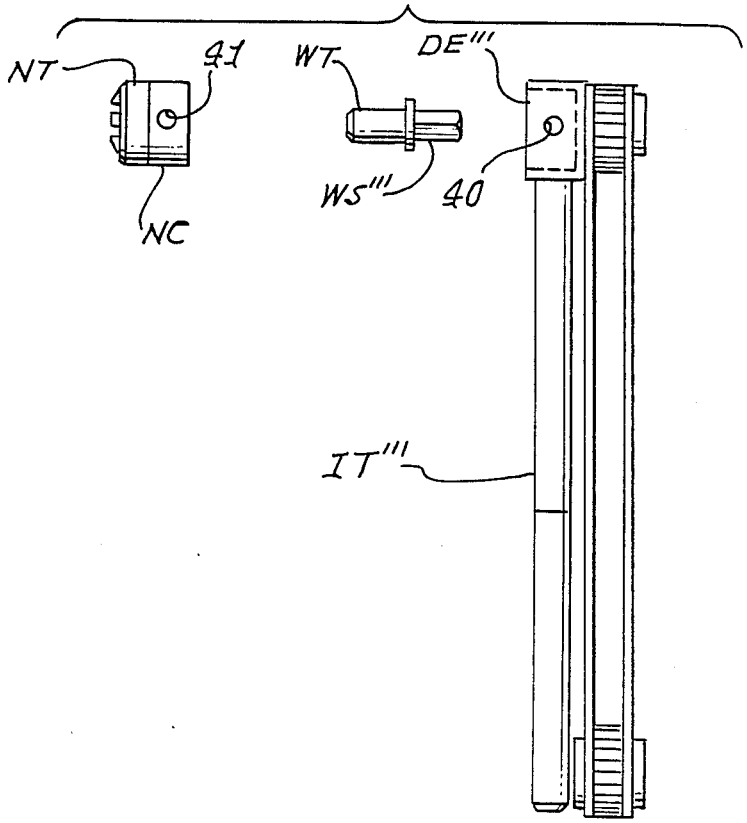
FIG. 13 is a view similar to FIG. 11 illustrating the assembled universal adapting elements as they may be coupled to a close quarter, hand installation tool.

Now referring to FIG. 13, a close quarter hand tool IT‴ will be examined relative to the universal adapting elements. The close quarter hand tool is basically the same as the hand tool IT″ of FIG. 12 but more compact for use in areas of limited space; i.e., "close quarters". The drive end for the close quarter tool is identified as the end DE‴. However, the adaping elements for the close quarter tool IT‴ has a wrench adapting system that only consists of two pieces, namely, the wrench tip element WT and the wrench shank adapting element WS‴. As in the previous hand operated tool IT″, the drive end of the tool IT‴ has a socket for receiving a hexagonal shaped shank element WS‴ in driving relationship therewith and to receive the assembled nose adapting elements NT and NC in a stationary relationship. In this embodiment an aperture 40 is provided on the side of the housing of the drive end DE‴ for receiving a set screw which will engage an aperture 41 provided for the nose connecting element NC of the nose adapter for maintaining the nose adapter stationary during the operation of the tool IT‴.

Figure 14:
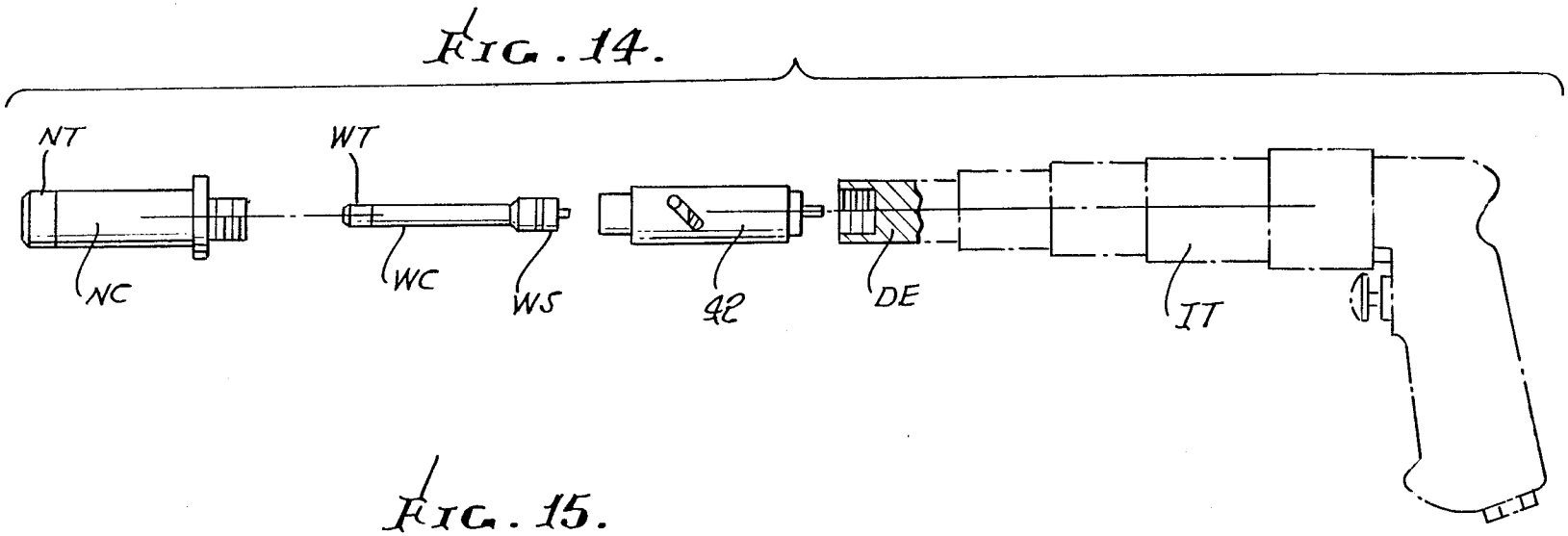
FIG. 14 is an exploded view of the assembled universal adapter elements as they may be employed with a torque responsive pneumatic pistol grip type of installation tool with the tool essentially illustrated in dotted outline and the driving end illustrated in cross-section.
Figure 15:
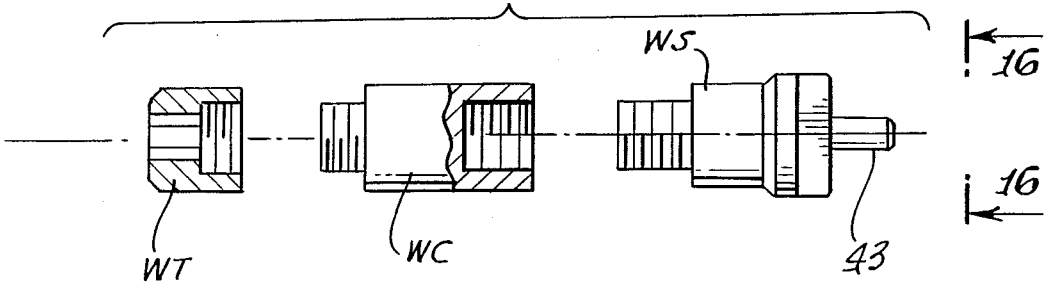
FIG. 15 is an exploded view of the wrench adapting elements of FIG. 14.
Figure 16:
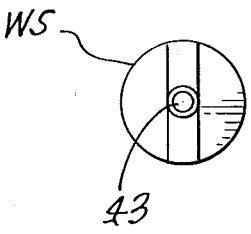
FIG. 16 is a sectional view taken along the line 16—16 of FIG. 15.

Now referring to FIGS. 14 through 16, a variation of the pneumatic pistol type installation tool IT illustrated in FIG. 1 is shown as including a master torque driver element 42 for coupling to the drive end DE of the tool IT. The master torque driver 42 is adapted to be directly coupled at its right hand end to the drive end of the tool IT, as illustrated, and to receive the wrench shank element WS at the opposite end thereof, as is evident from examining the exploded view of FIG. 14. FIG. 15 illustrates in an exploded relationship the three wrench adapting elements for the purposes of use in such a pistol grip, master torque installation tool assembly and is essentially the same as described hereinabove. The driven end of the wrench shank adapter WS has a stub shaft 43 configured to be rotatably coupled to the left hand end or output drive end of the master torque driver 42.

In the definition of the number of adapting elements for the universal system for a given dimension, it should be understood that generally a nose tip element NT is the same length for the blind fasteners identified as the Jo-Bolt, Visu-Lok and Composi-Lok blind fasteners. The coacting nose connector element NC is generally of the same length for the basic installation tools but may be required to be of a shorter length for certain types of installation tools, such as the above described right angle installation tools, for example. In the installation of the Visu-Lok II and the Composi-Lok II types of blind fasteners, the nose elements NT may vary in length but the nose connectors NC may vary in length for the various types of tools, such as the close quarter installation tool. The wrench tip elements WT of the universal system generally have the same length for the entire J-Bolt family, namely, Jo-Bolt, Visu-Lok I and II, Composi-Lok I and II. The wrench connectors WC are generally of the same length but in the use of certain composite materials, a larger clamping area may be necessary. This is a BF, "big foot" application and requires a wrench connector of a longer length. This can be provided by a single wrench connector of the desired length or a standard length connector plus an additional connector element secured thereto to provide the desired wrench connector length.

It should also be noted that various coupling techniques for coupling the nose adapting elements and the wrench adapting elements together may be utilized, although it has been found preferable to use threaded connections which are readily and quickly connectable and disconnectable. Threaded elements have the advantage that they are self-tightening during operation of an installation tool.

With the above concepts in mind, it should now be appreciated by those skilled in the art that the universal tool adapting elements of the present invention minimize the cost for installation tooling and permits simple and quick changes in adapter element sizes for the same installation tool, or simple and quick changes in the wrench shank elements for changes in installation tools. It also should be noted that since the adapting elements normally wear out first, and these are the elements that engage the blind fastener, namely, the nose tip element NT and the wrench tip element WT, that they can simply and quickly be changed in favor of a new tip element without an appreciable loss of time. The same concepts would apply to the universal adapting system for similar configured blind fasteners as they are developed for use with the present day installation tool or tools yet to be developed for special applications of the blind fasteners. It should also be appreciated that the fastener removal tools presently commercially available can utilize the nose tip elements of the present invention to assist in drilling out a fastener which has been improperly installed, or must be removed for some reason. The universal nose tip is also useable with fastener torque testing devices.

I claim:

1. Blind fastener installation apparatus for making a plurality of different blind fastener installation tools capable of installing a plurality of types and sized of blind fasteners of the kind having a stationary head element and a coaxial rotatable bolt element with a protruding wrenching end, said installation apparatus comprising:

a plurality of tubular nose connecting elements, each having body connecting means proximate one of its ends for establishing a releasable stationary connection with the body of a respective said installation tool, and each having nose tip connecting means proximate its other end for establishing a releasable stationary connection with a nose tip adapting element;

a plurality of nose tip adapting elements selectively operatively connectable with said nose connecting means of each of said nose connecting elements and adpated to hold a variety of said blind fastener head elements stationary against rotation during installation events;

a plurality of wrench connecting elements, each being adapted to be generally coaxially located within a said nose connecting element, each of said wrench connecting elements having torque input means proximate one of its ends for establishing a releasable connection with rotary drive means of a respective said installation tool, and each having torque output means proximate its other end for establishing a releasable connection with a wrench tip adapting element; and a plurality of wrench tip adapting elements selectively releasably operatively connectable with said torque output means of each of said wrench connecting elements and adapted to rotationally drive a variety of said blind fastener bolt element wrenching ends.

2. Apparatus according to claim 1, wherein said wrench connecting element torque input means comprises wrench shank adaptor means having a first end releasably connectable to a said installation tool rotary drive means and a second end releasably connectable to such wrench connecting element.

3. Apparatus according to claim 1, wherein said operative connections between said nose tip adapting elements and said nose connecting elements are threaded connections.

4. Apparatus according to claim 1, wherein said operative connections between said wrench tip adapting elements and said wrench connecting elements are threaded connections.

5. Apparatus according to claim 1, wherein said connections between said nose connecting elements and said installation tool bodies are threaded connections.

6. Apparatus according to claim 1, wherein said installation tools comprise a right angle type pneumatic driver.

7. Apparatus according to claim 1, wherein said installation tools comprise a ratchet type hand-driven driver.

8. Apparatus according to claim 1, wherein said installation tools comprise a close-quarter ratchet type hand-driven driver.

9. Apparatus according to claim 1, wherein said installation tools comprise a pistol grip, torque-responsive pneumatic driver.

10. Apparatus according to claim 1, wherein said nose tip adapting elements comprise a nose tip adapting element configured and adapted to be coupled to said blind fastener head elements configured as millable heads.

11. Apparatus according to claim 1, wherein said nose tip adapting elements comprise a nose tip adapting element configured and adapted to be coupled to said blind fastener head elements configured as protruding hexagonal heads.

12. Apparatus according to claim 1, wherein said nose tip adapting elements comprise a nose tip adapting element configured and adapted to be coupled to said blind fastener head elements contigured as flush type heads.

13. Apparatus according to claim 1, wherein said nose tip adapting elements comprise a nose tip adapting element configured and adapted to be coupled to said blind fastener head elements configured as reduced flush type heads.

14. Apparatus according to claim 1, wherein said nose tip adapting elements comprise a nose tip adapting element configured and adapted to be coupled to said blind fastener head elements configured as drive nuts.

* * * * *

UNITED STATES PATENT AND TRADEMARK OFFICE

CERTIFICATE OF CORRECTION

PATENT NO. : 4,836,062

DATED : June 6, 1989

INVENTOR(S) : Joseph S. LaTorre

It is certified that error appears in the above-identified patent and that said Letters Patent is hereby corrected as shown below:

On the face of the patent, Item [54], the title should read --UNIVERSAL TOOL ADAPTERS FOR BLIND FASTENER INSTALLATION TOOLS AND A UNIVERSAL METHOD FOR INSTALLATION OF BLIND FASTENERS--

Signed and Sealed this

Tenth Day of April, 1990

*Attest:*

HARRY F. MANBECK, JR.

*Attesting Officer*

*Commissioner of Patents and Trademarks*